United States Patent [19]

Reverte

[11] 4,419,939

[45] Dec. 13, 1983

[54] CONCEALED SAFE

[76] Inventor: Tomas M. Reverte, Calle Pedraforca 6,, Sant Cugat del Valles, (Barcelona), Spain

[21] Appl. No.: 235,145

[22] Filed: Feb. 17, 1981

[30] Foreign Application Priority Data

Dec. 6, 1980 [ES] Spain ..... 497.533

[51] Int. Cl.[3] ..... E05G 1/06; A47B 97/00

[52] U.S. Cl. ..... 109/54; 109/53; 109/23; 312/204; 312/270

[58] Field of Search ..... 109/50, 54, 53, 58, 109/49, 45; 312/204, 310, 270, 298; 220/23.4, 23.83, 20

[56] References Cited

U.S. PATENT DOCUMENTS 9,305 7/1880 Heineman ..... 109/54

3,999,493 12/1976 Galya ..... 109/54

4,083,314 4/1978 Garvin ..... 109/54

FOREIGN PATENT DOCUMENTS 619207 3/1949 United Kingdom ..... 109/53

*Primary Examiner*—Robert Peshock

*Assistant Examiner*—John Weiss

*Attorney, Agent, or Firm*—Michael J. Striker

[57] ABSTRACT

A concealed safe for safekeeping of small objects and valuables suitable for building into a wall comprises a hollow body formed with an upper compartment adapted to receive three drawers, and a lower compartment. The front wall of the safe is provided with an access opening which is closed with a plug socket after the drawers have been inserted into the safe. The plug socket is hingedly connected to the safe body and in its open position is adapted to move towards and outwards of the safe in a direction perpendicular to the front wall of the safe.

35 Claims, 13 Drawing Figures

FIG. 1
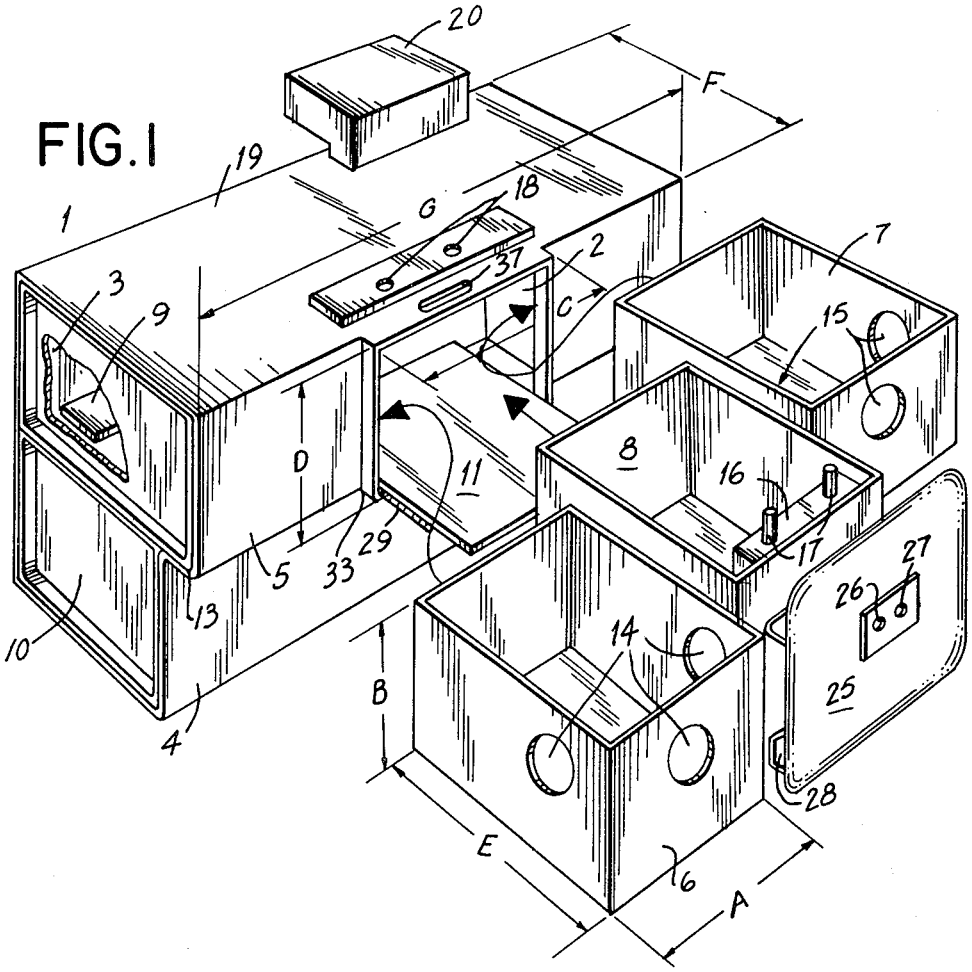
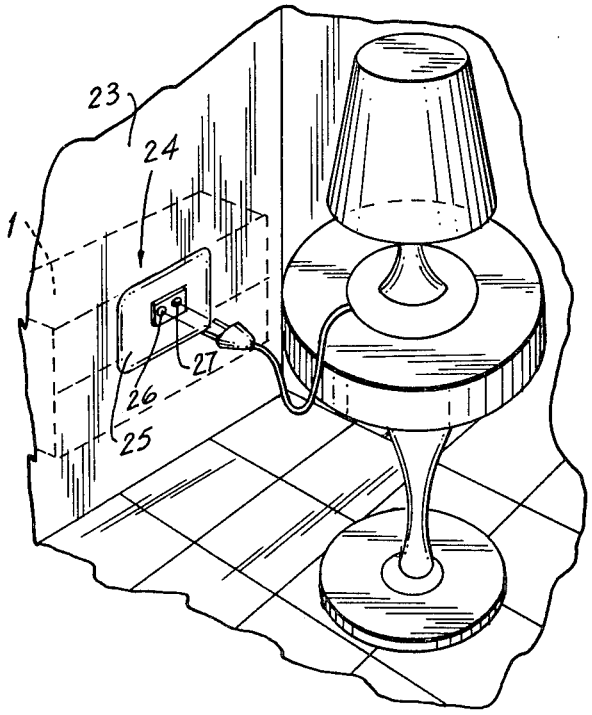
FIG. 2

CONCEALED SAFE

BACKGROUND OF THE INVENTION

This present invention refers to a concealed safe, particularly to a relatively small size safe suitable for building into a wall and for the safekeeping of small objects and valuables with the object of ensuring their safety and secrecy.

The characteristics of the form and operation of this concealed safe make it especially useful in the home. It follows that the concealed safe to which this invention refers has equally a suitable utilization in offices, factories, shops or any other place where it is required to safeguard relatively small objects.

Safes for the storage of money and valuables, designed to be hidden by the usual decorative elements such as curtains, pictures, window frames, false doors and so on are already known. Nevertheless a careful search of the area in which such a currently known type of safe is hidden leads to its discovery by a person unaware of its exact location. In fact once the picture, curtain, door or similar concealing element has been moved by the person searching there is revealed the very large and bulky opening mechanism of this type of safe. From thereon the actual opening of the safe, revealed by the searcher presents solely a problem of skill and mechanical procedure.

SUMMARY OF THE INVENTION

The concealed safe which is the object of the present invention has as its principal objective the possibility of being hidden with considerable efficacy, such that in a high percentage of cases its discovery can be prevented however meticulous and thorough may be the search operation.

Naturally, in anticipation of the improbable instance in which the concealed safe came to be discovered it is fitted with a locking device the unauthorized opening of which would require furthermore a considerable mechanical effort beyond the capability of a curious individual, an industrial or commercial spy or a common thief.

The functional aspect of the safe is characterized particularly by its unusual simplicity of operation in opening, also the useful arrangement of separate independent sections for the storage of jewelery, cash, valuables, documents, etc. Also of note, among the various advantages of this safe are the dimensions and arrangement of the said separate sections such that access to their contents is easy.

Finally, and equally being of great advantage, is that the the concealed safe as described herein can be equipped with an electrical system of disguise as well as an electrical alarm system which together provide an extraordinarily high degree of safety and efficiency.

The objects of the invention are attained by a concealed safe having an internally hollow body with a single frontal opening, its shape being delimited by that of a wide horizontal box the inside of which is defined by two parallelepiped compartments, one upper and one lower; the concealed safe also having three drawers of equal dimensions, two plain drawers and one door-drawer which are fitted precisely in the upper compartment such that it is possible to extract them and introduce them one after another in succession through the frontal opening; the concealed safe also having therein a removable tray on which the drawers can rest; the concealed safe also having a special electrical plug socket which can be fitted against the edge of the single frontal access opening by means of a complementary locking device operated from the outside of the safe.

The upper compartment of the concealed safe may be of greater depth than the lower compartment and as both compartments are on the same plane as the rear wall and the side walls, said upper compartment projects forward relative to the whole assembly.

The single access opening may be located precisely in the upper compartment and its dimensions may exceed slightly the dimensions of the front elevation of the three aforementioned drawers so as to allow them to be inserted and extracted from the compartment freely. The edge of the said opening is surrounded by a protruding flange projecting outwards.

The concealed safe may have inside a support ledge which projects perpendicularly from the rear wall at the same level as the lower edge of the opening thus delimiting the two compartments, upper and lower which together constitute the inside chamber of the concealed safe. This support ledge acts specifically as a rest for the rear edge of the three drawers. The supporting means for the drawers may be completed by a removable tray having a projecting piece on its underside to act as a stop, this tray being located in front of the opening, its front extremity resting on the lower edge thereof and its rear extremity on the support ledge inside the safe.

To obtain access to the lower compartment it is necessary to remove the three drawers and then remove the removable tray.

The two plain drawers may be provided with a number of holes so that they may be moved easily on introducing a hand into the opening left free by the door-drawer which obviously must be removed first with the use of the key which is required to open the lock situated at its front extremity. The bolts of this lock may protrude to the outside through suitable placed holes provided for this purpose in the upper wall of the concealed safe.

Additionally with the safe, a small casing may be provided which is fitted such that it determines the cavity into which the aforementioned bolts will enter on closing the lock.

Concealment of the door-drawer may be accomplished by means of special electric plug socket which may be attached to the edge of the front access opening.

The attachment of this special socket may be is achieved by means of the articulation of a hinge provided at the lower flange of the access opening to the concealed safe, in such a way that the hinge member which is connected to the body of the safe is lodged and held within a small casing located below the lower member of the flange round the opening while the hinge member connected to the special socket is fitted, with the possibility of assembling and disassembling the member, to a frame firmly attached to the said socket plate.

The aforesaid frame has a locking means having bolts on the upper edge thereof so such that in their closed position the bolts pass through a slot formed in the upper member of the flange of the opening in the body. The operation of this locking means may be carried out by means of a key with a narrow blade capable of passing through one of the terminal orifices provided in the special socket.

A particular characteristic, moreover of the hinge lies in its ability to be moved both forwards and backwards in a direction perpendicular to the front face of the safe, and for this purpose the hinge member, which is lodged in the casing, can slide therein in a longitudinal direction along guides which provide for its uniform and efficient movement in both directions, having also a stop which limits its maximum forward movement. It follows that on moving the hinge, the socket will also move such that its ability to articulate will be facilitated. The possibility of separating the socket from the wall results in avoiding the shock action of the edge of the socket against the wall. This is particulary advantageous when the socket plate is large, especially on its lower portion.

It is evident that it is of importance that the external appearance of the special socket be identical to the external appearance of the other sockets fitted in the room, that is that they have the identical shape and carry the same decorative characteristics.

It is particularly important that this concealed safe is provided with a power supply to the special socket so that it may be utilized in the same manner as other sockets in the building.

For this purpose the concealed safe of the invention may include a rigid protective tube below the protruding front as defined by the upper section, the internal extremity of this tube being so arranged that it ends adjacent to a passageway in the base of the casing containing one of the hinge members, inside the protective tube have at least two conductor wires connected respectively to the corresponding terminals of an electric supply through the hinge and terminate in a cable connector corresponding to a mating connector which in turn is the terminal of two conductor wires leading from the respective terminal orifices of the special plug socket.

Hence, the terminal connectors may be mutually joined in contact, the electric supply being fed to the plug sockets of the special socket which may in consequence be utilized as an ordinary plug socket for the operation of lights, radio, television, etc.

Normally the connection to the electrical supply will be through the main supply circuit of the room.

The cable taking the power supply to the special plug socket is provided with a safety switch located at some distance from the plug socket itself and the operation of this switch will establish the continuity or otherwise of the electrical supply to the socket. It will be necessary to cut off the supply of current before withdrawing the plug socket to minimize the risk of causing an electric discharge, which in the event of not doing so, is high, even in the event of using a key made of an insulating material or covered in an insulating material.

Furthermore, as an additional safety element, the special plug socket may be fitted with suitable insulating materials such as plates, grommets and other similar items so as to assist in avoiding the possibility of electrical contact between the terminal orifices and the other metallic components of the socket plate which are directly accessible.

Finally, as a more complete safety measure, the safety switch can be so arranged that it cuts off both the two conductors, such that during the normal operation of the concealed safe after switching off the safety switch, there remains no danger whatsoever to a person operating the safe being exposed to any such electrical discharge.

Equally important in the concealed safe, object of this invention, is that it should be fitted with an alarm system which would operate in the event when the plug socket is to be handled by any unauthorized person.

In practice, in view of the circumstances in which an unauthorized person may separate the plug socket from its point of connection at the front of the access opening of the safe, the concealed safe should be provided with an automatic contactor in an alarm system circuit, this automatic contactor having a switch which normally remains open and which closes at the instant when it is separated from a complementary stabilizing element situated near to it. The two lines, respectively to and from the alarm, form the circuit lead to the automatic contactor of the alarm circuit following the same path as the electrical conductors carrying the power supply to the terminal orifices of the special socket, that is passing through the protective tube and coming out through the passageway provided in the edge of the casing, in the region behind the special plug socket.

Naturally, the alarm circuit is provided at one point therein with an external switch, directly accessible, allowing the alarm to be taken out of the circuit so that a person who is a party to the secret may separate the plug socket without the alarm being set off. It would be an advantage that the external alarm circuit switch and the aforementioned safety switch governing the supply of electric current to the plug socket, are combined such that one single operation of a double contactor would break the two electrical circuits simultaneously.

The alarm circuit can be supplied either from the main electrical supply or from an independent source of power such as batteries, storage cells or other source independent of the main electrical supply to the locality. An autonomous energy source for the alarm circuit allows it to remain in a state of operation even in the event of the main supply from the said main circuit having been disconnected, by, for example directly isolating the incoming supply or by causing the disconnection of the electrical safety devices or fuses.

The alarm system warning signals, such as visual or audio warnings, can be situated where they are most suitable, either inside or external to the building.

An embodiment of the concealed safe in accordance with the present invention is shown by way of example only in the drawings which accompany this specification.

BRIEF DESCRIPTION OF THE DRAWING

FIG. 1 is a perspective view of a concealed safe according to the invention;

FIG. 2 is a partial perspective view, showing the external appearance of the concealed safe after it has been installed;

FIG. 5 is a section along V—V in FIG. 3;

DETAILED DESCRIPTION OF THE PREFERRED EMBODIMENTS

Figure 3:
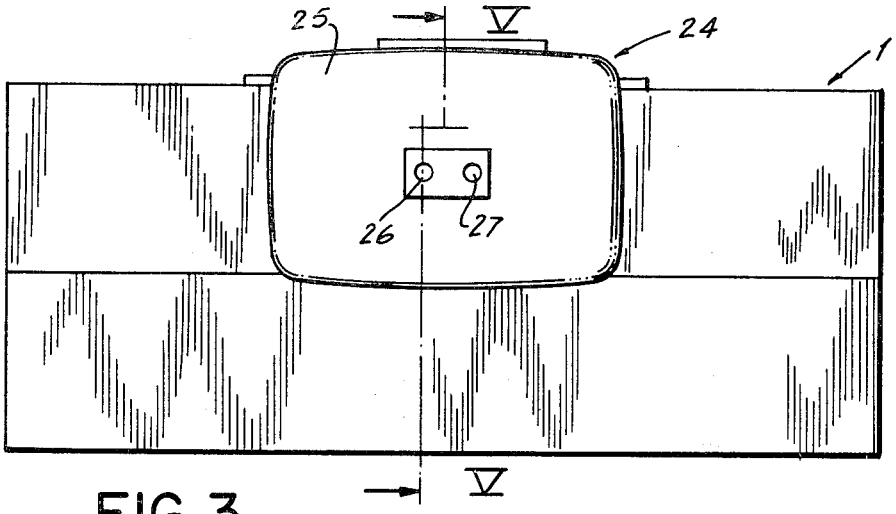
FIG. 3 is a front elevation of the safe.
Figure 4:
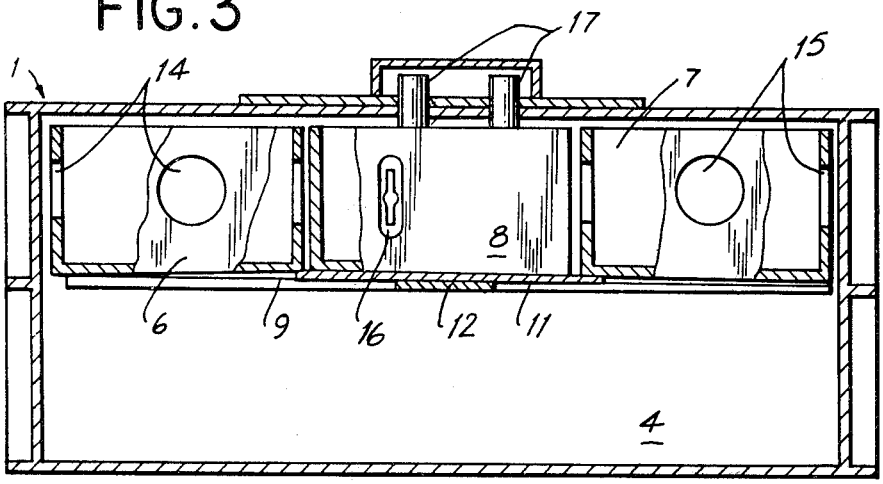
FIG. 4 is a section along the line IV—IV in the FIG. 5.
Figure 4:
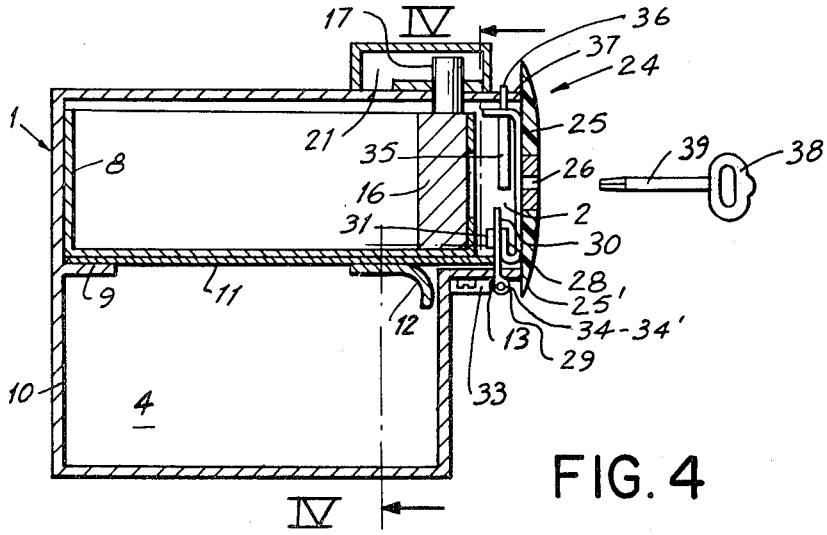

In FIG. 1 can be seen the concealed safe in accordance with the present invention comprising an internally hollow body 1 having a single frontal opening 2 allowing access to the inside thereof. The body 1, preferably, is of metal and very strong. The body 1 delimits a wide horizontal chamber 3 inside of which chamber are defined two parallelepiped shaped compartments, the lower compartment 4 and the upper compartment 5.

The upper compartment 5 is slightly deeper than the lower compartment 4, such that the former protrudes slightly forward.

The concealed safe also comprises two plain drawers 6 and 7 and a door-drawer 8. The three drawers 6, 7 and 8 are parallelepiped and are of mutually similar external dimensions. The width A and the height B of these three drawers are, respectively, slightly less than the width C and the height D of the frontal opening 2, so as to allow the drawers to be passed in and out of the opening without jamming. The depth E of the three drawers is slightly less than the internal depth F of the upper compartment 5 of the body 1, so as to allow them to be fully lodged therein.

To ensure a satisfactory seating of the three drawers 6,7,8, within the body 1, there is provided a support ledge 9 which projects perpendicularly from the lateral wall 10 and which is complemented by a removable tray 11 which is situated in front of the opening 2, between the lower edge thereof and the ledge 9. The removable tray 11 has on its under side a projecting lug 12 to act as a stop, preventing its accidental complete removal during the operation of taking out the drawers. FIG. 5 shows in greater detail the positioning of this removable tray 11.

The discontinuous arrows in FIG. 1 show the required procedure for the introduction of the drawers. Firstly either of the plain drawers 6 or 7 has to be introduced through the opening 2 and then pushed to one end or the other of the upper compartment 5 so as to leave free the opening 2 and permit the introduction of the other of the plain drawers 6 or 7 which is then positioned with a light push to the opposite end of the upper compartment 5; thus once again leaving the opening 2 free so that the door-drawer can also be inserted and thus blocking the opening 2.

It should be noted that the inner face of the step 13 determined by the protruding zone of the upper compartment 5 also serves as a support for the drawers, particularly the simple drawers 6 and 7.

The aforementioned simple drawers 6 and 7 have on their two side faces and on their front faces respectively, orifices 14 and 15 of a dimension sufficient for the introduction of the first phalanx of a finger. These orifices 14 and 15 are very useful in facilitating the operations of positioning within the body 1, particularly across the width of the upper compartment 5.

It is easily appreciated that the internal width G of the body 1 must be equal to or less than the sum of the widths (3×A) of the three drawers 6, 7 and 8 so as to permit their being placed in the upper compartment 5. Preferably the width G should very slightly exceed the value (3×A) so as to obviate jamming or unnecessary play.

The door-drawer 8 has fitted a lock 16 the bolts 17 of which, pass through corresponding orifices 18 in the upper face 19, near the front edge of the body 1.

A small suitable strong casing 20 completes the lock 16 forming a cavity 21 in which will lodge the bolts 17 of the lock 16 once the latter is in its locked position.

Figure 6:
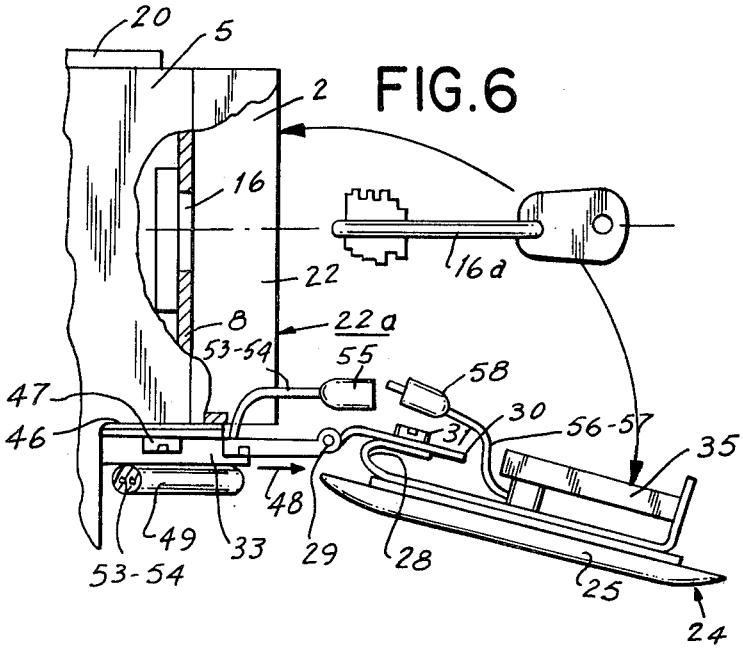
FIG. 6 is a partial elevation of the side of the concealed safe showing the access area, part cut away.

The opening action of lock 16 is by use of a key 16*a* which is shown in FIG. 6.

The shape of the body 1 is completed by a flange member 22 protruding towards the exterior and which surrounds the opening 2 along the edge formed by its whole perimeter.

The whole assembly forming the structure of the body 1 herein described is designed for building into a wall in such a manner that the free edge 22*a* of the flange 22 is flush with the outside surface 23 of the wall as may be seen in the FIG. 2. It follows that the thickness of the wall should be greater than the depth F of the body 1. Thus the only exposed part will be the opening 2, allowing access to the interior 3 of the body 1 for the purpose of inserting and removing the three drawers 6,7 and 8.

The concealed safe, in accordance with the invention is also provided with a special plug socket 24 with the specific object of concealing the opening 2, and for which purpose it is attached to it and in particular to its flange 22.

FIG. 2 shows the final arrangement of the safe having been built into the wall 23. In fact the only directly visible component is the outer face of the special socket 24. Obviously the outer plate 25 of the socket 24 will for preference be of the same appearance as the other plates in the same room or precinct such that there is no outward sign that would make it distinguishable. It is particularly preferable to utilize currently marketed types of sockets and to modify them to the requirements of the special socket 24 in each case.

FIG. 5 shows that the special socket 24 comprises the plate 25, the terminal orifices 26 and 27 and a frame 28 which is rigid and firmly attached to the plate 25.

The special socket 24 is connected to body 1 by means of a hinge 29. One member of the hinge 30 is held by threaded means of attachment 31 to the frame 28. The other member 32 of the hinge 29 is fitted inside the small casing 33 situated under the opening 2 or more precisely, below the lower member of the projecting flange 22.

By these means the special socket 24 fits against the opening 2 and can be separated from it by articulating on the hinge pin of the hinge 29, that is on the axis 34—34'. The connection of the special socket 24 to the opening 2 is completed by means of the locking means 35 which is firmly attached to the frame 28 on its upper zone such that a bolt 36, in moving outwards passes through a slot 37 formed in the upper side of the flange 22. FIGS. 1 and 5 show clearly this slot.

In order to open and close this locking means 35, use is made of a key 38 of which the blade 39 is sufficiently narrow to pass through one of the terminal orifices 26 or 27 of the socket 24, and which reaches the locking means 35 situated behind the plate 25.

From the foregoing it can readily be seen that the access to the interior of the concealed safe is obtained very easily. In the first place it is sufficient by using the key 38, to withdraw the bolt 36 and thus cause the special socket 24 to be able to separate itself by hinging downwards in articulating on the hinge pin 34—34' of the hinge 29. However this giratory movement can be difficult or even prevented in the case of the lower zone of the plate 25 being prolonged downwards. In effect under these conditions there is the possibility that in hinging downwards the lower edge 25' of the plate 25 will be impeded by contact with the wall 23. To overcome this difficulty there is provided an ingenious means which allows the hinge 29 to be displaced forward and downward in a direction perpendicular to the front face of the box 1, that is in a direction which is perpendicular to the outside surface of the wall 23.

Figure 7:
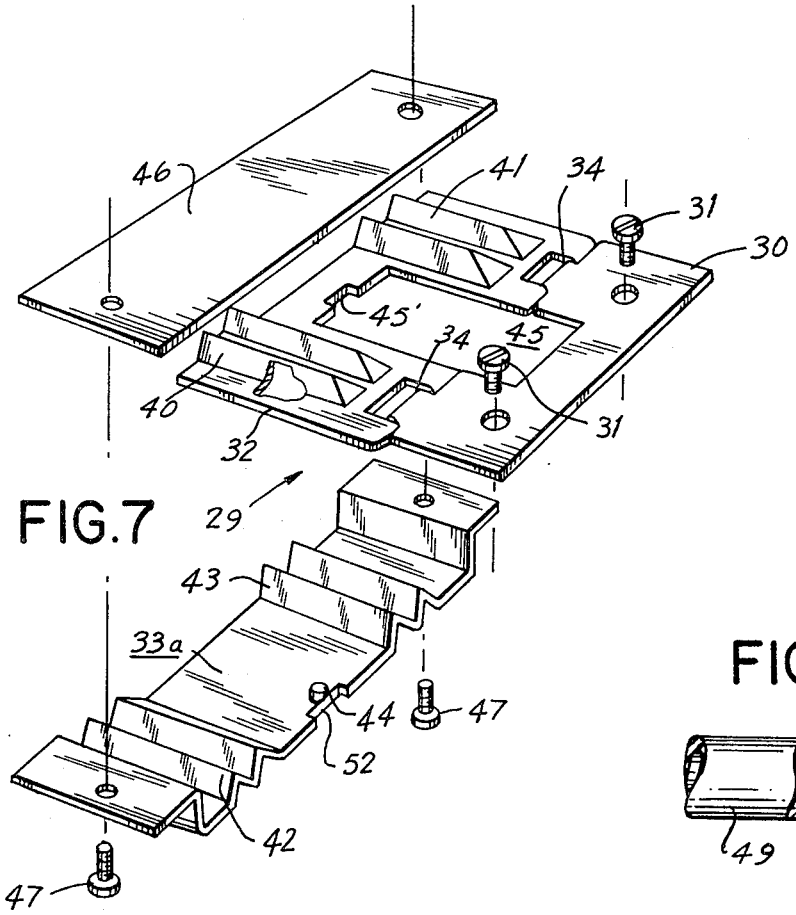
FIG. 7 is an exploded perspective view showing details of the means of articulation in this specific embodiment.

FIG. 7 shows in full detail the components that permit this displacement of the hinge 29. As previously mentioned the hinge member 30 is the hinge-plate which is fitted to the frame 28 which forms part of the socket 24.

The other hinge member 32 has longitudinal ribs 40 and 41, disposed as to one on each side and which correspond to tracks 42 and 43 formed in the baseplate 33*a* of the casing 33. This allows the member 32 to move forward and backward. The backward limit of the movement is established by the rear wall of the casing 33 and/or the rear extremity of the tracks 42 and 43. The forward limit of movement is established by a stop 44 provided for this purpose adjacent to the front edge of the base 33*a* and which corresponds with a longitudinal opening 45 provided in the said hinge plate 32. Contact with the rear edge 45' of the opening 45 determines the limit of travel. The top side 46 of the casing 33 allows for the adjustment of the assembly.

The threaded means 47 are the means for attaching the casing 33 to the hinge 29. Once the concealed safe has been built in to the wall 23 the heads of the threaded means 47 will be encased in mortar or such similar material as has been used in anchoring the safe itself and the hinge 29, it should be noted, it can then no longer be disassembled. The socket 24, however can be removed as required for repair, adjustment or for substitution by another due to the possibility of access to the attachment means 31 used in the fitting of the socket.

FIG. 6 shows a part of the concealed safe in a side elevation. In this drawing the hinge 29 is seen in its forward position in the direction shown by the arrow 48 and the socket 24 is hinged forward leaving the opening 2 exposed and consequently leaving the lock 16 accessible. This therefor is the intermediate stage of the operation to be carried out in order to obtain access to the interior of the concealed safe. To continue with the operation of opening the concealed safe, use is made of the key 16*a* to withdraw the bolts 17 after which the door-drawer 8 can be withdrawn from the interior of the concealed safe, following which the drawers 6 and 7, one after the other in either order can be taken out. For the operation of closing, the above steps are followed in the reverse order.

The three drawers 6, 7 and 8 are particularly useful for holding small objects such as jewels, cash, watches etc. The lower compartment 4 is especially suitable for the storage of documents, letters, banknotes, and larger objects in general.

The concealed safe as has been described above can be utilized with a high degree of security but the secrecy can be hidden with even greater security with the concealed safe fitted with a source of power supply.

The above mentioned FIG. 6 shows the essential components needed to supply electrical energy to the terminal orifices 26 and 27.

A suitably rigid protective tube 49 is fitted underneath the projection or front step 13 defined by the upper compartment 5. This protective tube 49 has an elbow 50 so placed so that its inside extremity 51 terminates adjacent to a gap 52 provided in the base 33*a* of the casing 33.

At least two conductor wires, 53 and 54 are provided inside the tube 49, connected exteriorly to the respective terminals of an electrical supply. These two conductor wires 53 and 54 pass through the gap 52 thus arriving in the space above the hinge 29, behind the special socket 24 where they terminate in a connector terminal 55 (FIG. 8).

To conduct the power supply to the terminal orifices 26 and 27 the latter are connected to wires 56 and 57 which equally terminate in a connector terminal 58 which can mate with the terminal 55 described above. Consequently a voltage differential is obtained at the terminal orifices 26 and 27 once the connector terminals 55 and 58 are joined together.

The connector terminals 55 and 58 enable the special socket 24 to be assembled and disassembled or even changed without any difficulty, as has already been explained.

Figure 8:
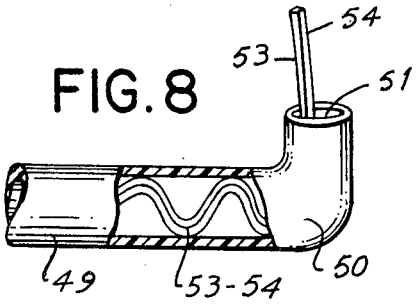
FIG. 8 is also a partial detail of one component of the concealed safe.

A partly cut away part of the protective tube 49 is shown in FIG. 8 and therein can be seen the two conductor wires 53 and 54 in a serpentine form such that their length is somewhat greater than the containing tube 49 so that when the hinge 29 is folded downwards there is sufficient excess wire within the tube 49 to extend and so as to compensate for the extra length required. Equally when the hinge is reinstated upwards the excess wire will return to the tube 49.

Figure 9:
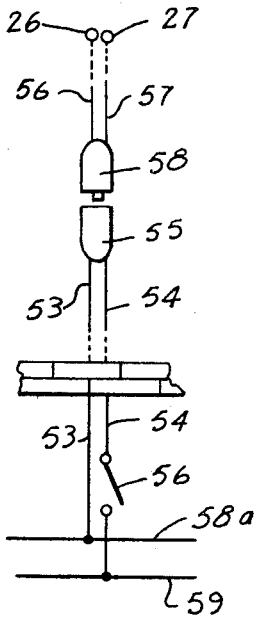
FIG. 9 shows a wiring connection diagram.

FIG. 9 shows the circuit diagram of the electrical connections as described above. Mention has been made of a switch 56' to shut off the power supply to the terminal orifices 26 and 27 so that the concealed safe may be operated in greater safety. This switch 56' is preferably at some distance from the place where the concealed safe in installed, even behind the wall 68 as shown in the diagram.

The electric conductors 58*a* and 59 which are the power supply leads shown in this embodiment are part of the main supply system.

So as not to complicate the drawings unnecessarily there has been omitted the means of insulation, using fully known techniques, which would be incorporated into the assembly of the special socket 24, as insulating plates, grommets, washers and other similar means. This would prevent short circuits or contacts with any other metal component of the concealed safe and which could represent a source of danger. If so desired the overall safety of the installation can be further enhanced by using a two-pole switch in place of a single pole switch 56', thus isolating the two wires 53 and 54 at the same time. Thus, in the event of an accidental polarity inversion, a supply to one of the terminal orifices 26 or 27 is avoided.

It is clear that electrical layouts, other than those shown in the embodiment may be employed, this aspect not being directly pertinent to the invention.

The concealed safe attains its maximum level of security when it is fitted with an alarm system which comes into operation automatically when the socket 24 is removed without the alarm system having previously been disconnected.

In effect, this places one more obstacle in the path of a person who, by one means or another has overcome the difficulties and problems so far described.

For this purpose the concealed safe has an automatic contactor 60 (FIGS. 10, 11, 13) fitted behind the special socket 24 and in series with the electrical conductor 61 of an alarm circuit 62. This automatic contactor includes therein a switch 63 which prevents the supply of electric current needed to operate the alarm circuit. This switch 63 closes when the automatic contactor 60 is out of contact with a complementary stabilizing component 64, situated nearby. Preferably, the stabilizing component 64 would be fitted inside the door-drawer 8 on its inner front face.

It is clear that the alarm circuit 62 can only operate when the exterior alarm circuit switch 65 is closed. Then, the separation of the two basic components, the automatic contactor 60 and the stabilizer 64 causes the closure of the switch 63 which then causes the alarm circuit 62 to go into operation. This situation will occur when an unauthorized person interferes with the socket 24 and succeeds by one means or another in detaching it with the intention subsequently of forcing the lock 16 of the door-drawer 8.

Persons who are party to the secret, will open the switch 65 prior to operating the socket 24 and thus prevent the alarm circuit 62 from functioning.

The two wires of the electrical conductor 61 are fed to the area behind the socket 24 by the same route as the electrical conductors 53 and 54, that is, inside the protective tube 49 and through the gap 52. Two connectors 66 and 67 allow the socket 24 to be dismantled for repair, adjustment or to be changed without the electrical conductor 61 interfering with the operation in question.

Figure 10:
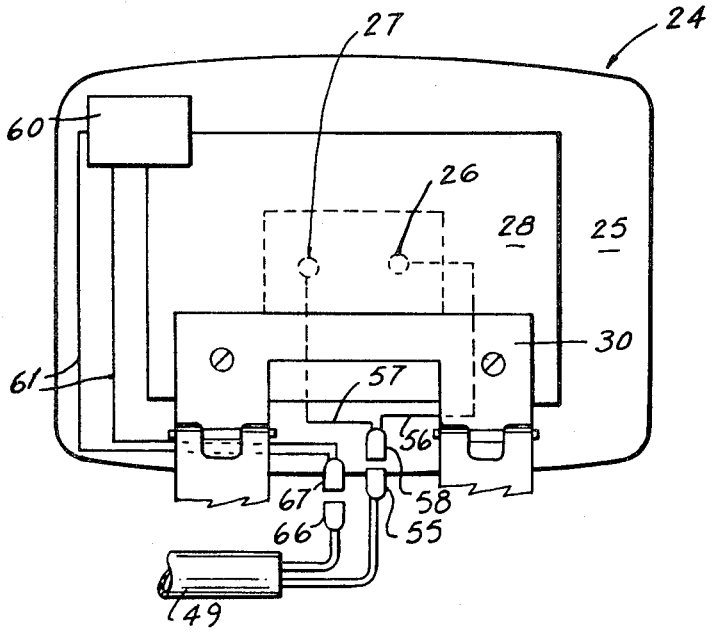
FIG. 10 is a fragmentary diagrammatic view, from the front, showing the method of fitting the alarm.

FIG. 10 is a sketch of the arrangement of the components situated behind the socket 24.

Figure 11:
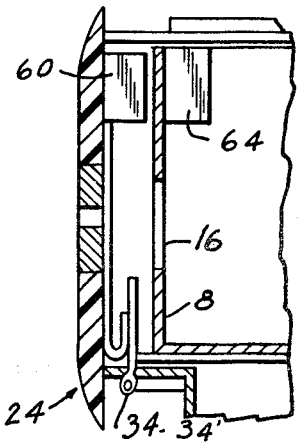
FIG. 11 is another diagrammatic view related to the alarm.

FIG. 11, also, is a sketch showing the relative positions of the automatic contactor 60 and the stabilizer 64. This shows clearly that on articulating the socket 24 around the hinge pin 34—34' of the hinge 29 the two aforementioned components, that is the automatic contactor 60 and the stabilizer 64, on being separated will cause the closure of the switch 63.

Figure 12:
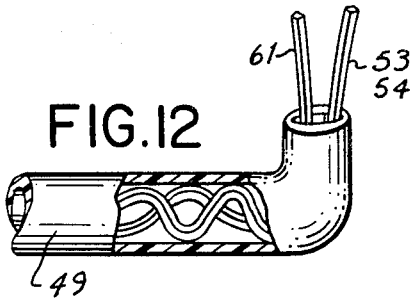
FIG. 12 is an assembly detail.

FIG. 12 is a fragmentary view of the protective tube 49 containing therein the electrical conductors 53 and 54 of the power supply system and the two leads, positive and negative, of the electrical conductor 61 which are disconnected by the automatic contactor 60.

Figure 13:
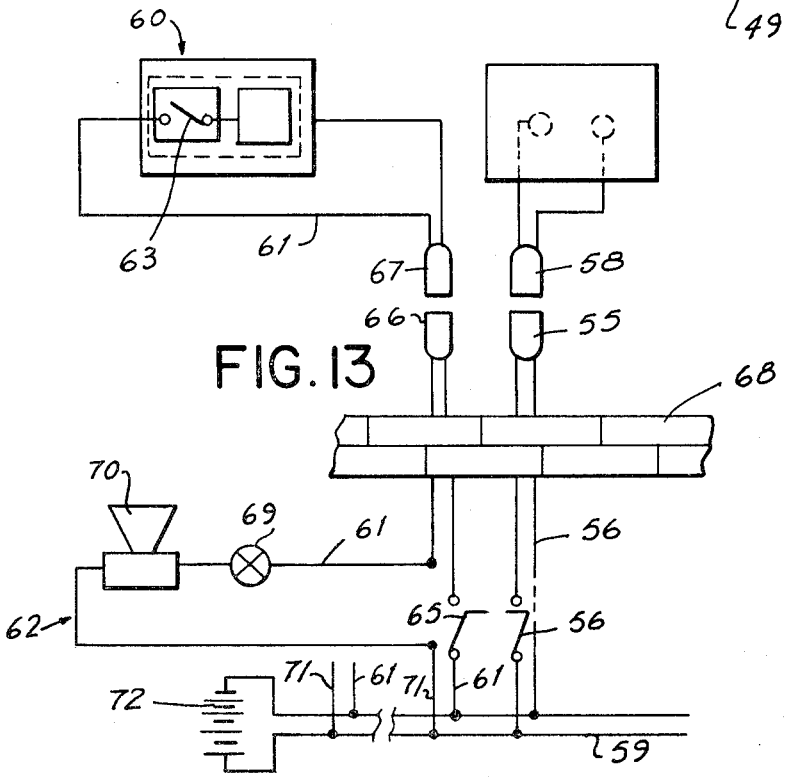
FIG. 13 is an electrical circuit diagram.

FIG. 13 is solely one example of a circuit showing the electrical connections outside the concealed safe. It is assumed that these connections will have been made after the electrical leads will have been taken through the wall 68. It can be seen that the two switches 56' and 65 are combined as a double circuit breaker so that the operation of disconnection and connection can be effected in one single manoeuvre. Moreover, if so desired this method of disconnection can be extended to all the conductors leading to the socket 24 in order to improve the safety and the efficiency of operation.

Also it is pointed out that a visual alarm 69 and an audible alarm 70 have been drawn solely by way of examples, inasmuch as the number and nature thereof, acoustic, luminous, or other may be selected completely independently of the characteristics of this present invention.

Finally it should be mentioned that in each case there exists the option of connecting the alarm circuit to the general mains supply or to an autonomous and independent power source which would ensure its continued operation even in the event, for some reason or other, of an interruption in the mains supply. FIG. 13 illustrates this double possibility with an autonomous battery 72 on the left of the diagram, the poles of which feed the two conductors 61 and 71.

It will be understood that each of the elements described above, or two or more together, may also find a useful application in other types of concealed safes differing from the types described above.

While the invention has been illustrated and described as embodied in a concealed safe, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters Patent is set forth in the appended claims:

1. A concealed safe, comprising a hollow body having a front wall, a rear wall and two opposite lateral walls and formed with an internal chamber horizontally extending between said lateral walls, said chamber including an upper compartment of substantially parallelepipedal shape and a lower compartment of substantially parallelepipedal shape, said front wall being formed with an access front opening; a first lateral removably-insertable drawer; a second lateral removably-insertable drawer; a central removably-insertable door-drawer, said drawers being adapted to be introduced into said upper compartment through said front opening in turn one after another such that the first lateral drawer is introduced through said opening and shifted in said upper compartment towards one of said lateral walls to free said front opening, then the second lateral drawer is introduced through said opening and shifted in said upper compartment to another of said lateral walls to free said opening and afterwards said central door-drawer is introduced into said upper compartment through said front opening so that all said drawers are fitted in said upper compartment in the insertable position, said drawers being adapted to be extracted from said upper compartment also in turn through said opening; a removable tray positioned between said upper compartment and said lower compartment for supporting said drawers during their introduction into said upper compartment through said opening, said tray being slidably displaced to and from said front opening; an attachable plug socket adapted to be positioned against said front opening to close the latter or to be moved from said front opening to release the latter; and locking means for locking said plug socket operated from the exterior of said body.

2. The safe of claim 1, wherein said front wall in the area of said upper compartment has a portion projecting forwardly relative to said lower compartment.

3. The safe of claim 2, wherein said front opening is formed in said portion.

4. The safe of claim 3, wherein said portion is formed with a flange projecting outwardly thereof and surrounding said front opening.

5. The safe of claim 4, wherein said rear wall is formed with a ledge extending between said lateral walls and perpendicular thereto and adapted to support said drawers in said insertable position.

6. The safe of claim 5, wherein said front opening has a lower edge, said ledge extending at the level of said lower edge.

7. The safe of claim 6, wherein said tray is provided with a lug downwardly extending therefrom and adapted to restrain said tray from complete extraction from said body when said tray is slidably displaced to said opening.

8. The safe of claim 7, wherein said tray has a front edge resting on said lower edge of said front opening and a rear edge resting on said ledge.

9. The safe of claim 8, wherein said first lateral drawer and said second lateral drawer each has side walls provided with holes for facilitating the insertion and removal of said lateral drawers into and from said upper compartment.

10. The safe of claim 9, further including hinge means for providing a swingable movement of said plug socket relative to said front opening between an open and closed positions.

11. The safe of claim 10, wherein said flange includes an upper wall and a lower wall, said hinge means being mounted on said lower wall.

12. The safe of claim 11, wherein said plug socket includes a socket plate and a frame rigidly secured to said socket plate, said socket plate being formed with two terminal orifices passing transversely of said socket plate.

13. The safe of claim 12, wherein said hinge means include a hinge plate connected to said frame.

14. The safe of claim 13, wherein said plug socket includes a locking device having a locking element secured to said frame and a bolt, said upper wall of said flange being formed with a slot, said bolt being inserted into said element and extended through said slot to lock said plug socket against said front opening.

15. The safe of claim 14, wherein said locking device is provided with a key having a blade to be inserted into any one of said terminal orifices for releasing said locking device from the exterior of said body.

16. The safe of claim 15, wherein said key is made of non-conductive material.

17. The safe of claim 15, wherein said key at least partially coated with non-conductive material.

18. The safe of claim 15, wherein said hinge means are provided with means for displacing said plug socket forwards and backwards in a direction perpendicular to said front wall of said body.

19. The safe of claim 18, wherein said displacing means include a first plate provided with longitudinal ribs outwardly extending therefrom and a second plate provided with tracks matching with said ribs, said first plate being connected to said hinge plate and adapted to slide relative to said second plate.

20. The safe of claim 19, further including an electrical circuit connected to a source of electric energy and including at least two electrical conductors feeding respective terminal orifices and at least one switch to actuate said circuit.

21. The safe of claim 20, wherein said source of electric energy and said switch are remote from the safe.

22. The safe of claim 21, including a protective tube positioned below said lower wall of said flange and adapted to receive said electrical conductors, said lower wall being provided with a gap, said electrical conductors passing through said gap into said body behind said plug socket.

23. The safe of claim 22, wherein said electrical conductors have mutually connectable terminals positioned behind said plug socket.

24. The safe of claim 23, wherein said plug socket is provided with electrical insulation.

25. The safe of claim 24, further including an automatically operating alarm circuit including an automatic contactor and a break switch positioned externally of the safe, said alarm circuit being switched on into automatic operation when said plug socket is detached from said front opening of said body.

26. The safe of claim 25, wherein said plug socket has a rear wall facing said chamber of said body, said automatic contactor being mounted on said rear wall.

27. The safe of claim 26, wherein said alarm circuit includes a stabilizing component located within said chamber, said automatic contactor operating in conjunction with said stabilizing component.

28. The safe of claim 27, wherein said alarm circuit further includes electrical conductors feeding said automatic contactor from an external source of electric energy, said electrical conductors of said alarm circuit being positioned within said protective tube and passing through said gap into said body to a position behind said plug socket.

29. The safe of claim 28, wherein said electrical conductors of said alarm circuit have mutually connectable terminals situated behind said plug socket.

30. The safe of claim 29, wherein said external source of electric energy is the main electricity supply.

31. The safe of claim 29, wherein said external source of electric energy is an autonomous source independent of the main electricity supply.

32. The safe of claim 29, wherein said alarm circuit is provided with alarm signals and remote control electronic means electrically connected thereto.

33. The safe of claim 32, wherein said alarm signals are optical.

34. The safe of claim 32, wherein said alarm signals are acoustic.

35. The safe of claim 32, wherein said body and said plug socket are mountable into a building wall so that said plug socket is flush with the building wall.

* * * * *